United States Patent [19]

Pacione

[11] Patent Number: 5,025,978

[45] Date of Patent: Jun. 25, 1991

[54] TWO-PIECE FOLDER

[76] Inventor: Peter L. Pacione, 755 The Queensway East, Mississauga, Ontario, Canada, L4Y 4C5

[21] Appl. No.: 519,770

[22] Filed: May 7, 1990

[30] Foreign Application Priority Data

Apr. 24, 1990 [CA] Canada ..... 2015286

[51] Int. Cl.[5] ..... B65D 27/00

[52] U.S. Cl. ..... 229/1.5 R; 229/72; 40/359; 493/264

[58] Field of Search ..... 229/1.5 R, 72, 87.5; 40/359; 493/210, 264

[56] References Cited

U.S. PATENT DOCUMENTS

| | | | |
|---|---|---|---|
| 981,366 | 1/1911 | Boyce . | |
| 3,516,599 | 6/1970 | Buttery | 229/72 |
| 3,643,363 | 2/1972 | Biro | 281/45 |
| 3,933,294 | 1/1976 | Meenan | 229/1.5 |
| 4,262,838 | 4/1981 | MacKenzie | 229/72 |
| 4,477,013 | 10/1984 | Herrin | 229/1.5 |
| 4,758,022 | 7/1988 | Podosek et al. | 229/1.5 R X |
| 4,764,159 | 8/1988 | Mitsuyama | 493/189 |

FOREIGN PATENT DOCUMENTS

| | | | |
|---|---|---|---|
| 494596 | 3/1930 | Fed. Rep. of Germany | 40/359 |
| 3027919 | 2/1981 | Fed. Rep. of Germany . | |
| 912579 | 8/1946 | France | 229/1.5 R |

*Primary Examiner*—Stephen Marcus
*Assistant Examiner*—Jes F. Pascua

[57] ABSTRACT

The present invention provides a two-piece kit for a portfolio folder which is readily adapted to be purchased by a small photocopy or printing center. The front panel of the kit is sized to become comparable to that of normal paper sizes and readily adapted to have printed material applied to at least one side thereof by use of standard sized photographic or offset printing equipment. After application of indicia or printed matter to the front panel, the components of the kit are then assembled by securing the front panel to the rear panel. The kit and method in accordance with the present invention permit small quantities of folders to be provided with customized printing on the front panel at relatively low cost.

15 Claims, 2 Drawing Sheets

TWO-PIECE FOLDER

SCOPE OF THE INVENTION

This invention relates to paperboard folders and, more particularly, to a folder having a front panel hinged to a rear panel with a pocket formed on the rear panel.

BACKGROUND OF THE INVENTION

Many folders are known which have a one-piece construction formed to have a front panel, a rear panel and a pocket at a lower front portion of the rear panel. Such portfolio folders are useful as, for example, to contain information and promotional materials which are desired to be presented to others in a pleasing, convenient format. Known folders are frequently constructed of light cardboard and bristol board.

It is desirable to provide printed material on the exterior of the front and/or rear panels. Previously known one-piece file folders have a major disadvantage that to print material on the one-piece paperboard blank to form the folder requires both die cutting equipment and a printing press of substantial size. This requires increased costs and, in particular, substantial costs for the plates to print the large one-piece blank. Such prior art one-piece folders are, therefore, expensive to print except when printing large quantities.

Disadvantages of known one-piece folders are that a few folders cannot be printed except at generally prohibited cost and, as well, require a considerable turnaround time for delivery.

SUMMARY OF THE INVENTION

To at least partially overcome these disadvantages of known one-piece folders, the present invention provides a two-piece folder with a separate front panel which can readily be photocopied or printed in a small offset printing press or facility.

In one of its objects, the present invention provides a two-piece paperboard folder whose front panel can readily be photocopied or printed in a small offset printing press or facility.

Another object is to provide a kit for a folder which comprises two panels with the rear panel carrying preformed pocket means and means to secure the front panel to the rear panel.

Another object is to provide a method for printing and assembly of a file folder from a two-piece file folder kit.

The present invention provides a two-piece kit for a portfolio folder which is readily adapted to be purchased by a photocopy or printing centre. The front panel of the kit is sized to become comparable to that of normal paper sizes and readily adapted to have printed material applied to at least one side thereof by use of standard sized photographic or offset printing equipment. After application of indicia or printed matter to the front panel, the components of the kit are then assembled by securing the front panel to the rear panel. The kit and method in accordance with the present invention permit small quantities of brochures to be provided with customized printing on the front panel at relatively low cost and quick turnaround.

In a first aspect, the present invention provides a kit for a portfolio folder comprising:

a separate first panel;

a separate second panel;

adhesive means for securing the first panel to the second panel, said first panel comprising a rectangular sheet having a thin elongate flap portion along one side edge thereof delineated from a remaining rectangular portion of the first panel by a hinge-forming scoreline parallel to said one side edge, said second panel comprising a rectangular sheet of dimensions substantially the same as that of said remaining rectangular portion, one of said first and second panels having a pocket means on a surface thereof, said first panel adapted to be secured to the second panel with said flap portion folded along said scoreline and said flap portion overlying a thin elongate side portion of said second panel along a side edge thereof, said adhesive means secured to one of said flap portion and side portion, said adhesive means having a removable release sheet for removal to activate the adhesive means for adhesion to the other of the flap portion and side portion.

In a second aspect, the present invention provides a method of manufacture of portfolio folders from a kit in accordance with the first aspect comprising applying printed material to a front face of the first panel and thereafter securing first and second panels together.

BRIEF DESCRIPTION OF THE DRAWINGS

Further aspects and advantages of the present invention will appear from the following description taken together with the accompanying drawings in which.

DETAILED DESCRIPTION OF THE DRAWINGS

Figure 1:
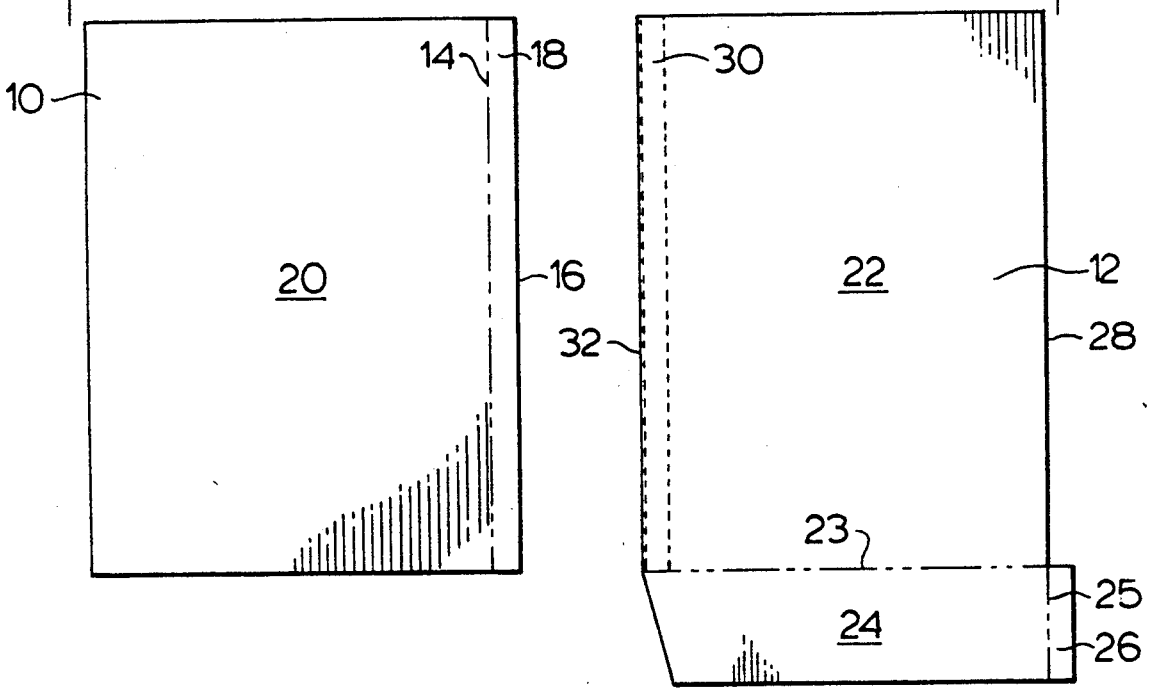
FIG. 1 is a plan view showing a front and rear panels of a kit in accordance with a first embodiment.
Figure 2:
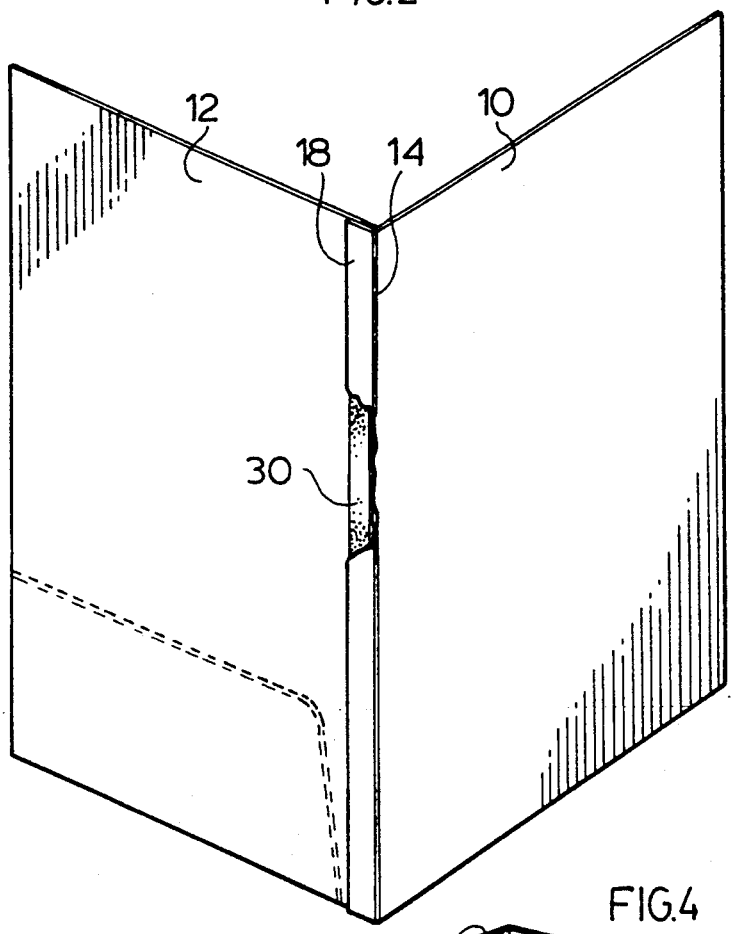
FIG. 2 shows the kit of the first embodiment of FIG. 1 assembled.

Reference is made first to FIGS. 1 and 2 showing a kit in accordance with a first embodiment. The kit comprises a separate front panel 10 and a separate rear panel 12.

Front panel 12 comprises a rectangular sheet of paperboard having a hinge-forming scoreline 14 near one side edge 16 so as to define a thin elongate flap portion 18 between the scoreline 14 and the side edge 16 and a remaining rectangular portion 20 comprising the rest of the front panel other than flap portion 18.

Rear panel 12 comprises a planar sheet of paperboard of irregular shape having two scorelines 23 and 25 which serve to delineate the rear panel into a rectangular, major portion 22, pocket portion 24 and pocket flap 26. The rear panel is preassembled to form a pocket by having pocket flap 26 folded along scoreline 25 over pocket portion 24 and then pocket portion 24 folded along scoreline 23 to lie on top of the front face of major portion 22. Pocket flap 26 may be permanently secured as by adhesive to major portion 22 as along its lower side edge 28.

Rear panel 12 carries an adhesive strip generally indicated 30 on the rear surface of panel 12 adjacent its side edge 32.

Figure 3:
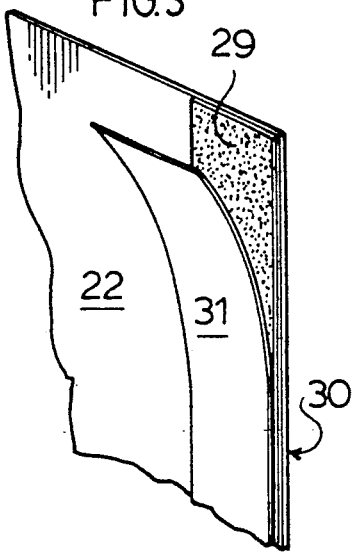
FIG. 3 shows an enlarged view of an adhesive strip of FIGS. 1 and 2.

As seen in FIG. 3, the adhesive strip 30 comprises a elongate strip of adhesive material 29 permanently secured on its undersigned to major portion 22 and having a release strip 31 covering its entire length. With the release strip 31 removed, the adhesive strip 30 is then activated and able to engage and permanently secure to flap portion 18. A preferred strip is sold by Fasson Canada Inc. under the trade mark DUBL-STIK TAPE.

As seen in FIG. 2, the front panel and rear panel of the kit of FIG. 1 have been assembled by placing the front surface of flap portion 18 of the front panel 10 over the rear of major portion 22 of rear panel 12 so that the inside surface of the flap portion 18 is engaged by the activated adhesive strip 30 thereby permanently securing the front panel to the rear panel with the scoreline 14 aligned to be parallel to the side edge 32 of rear panel 12. As assembled, the kit provides a file folder with a convenient pocket 29 into which paper sheets can be placed and then protected by the front panel folded along scoreline 14 to overlie the rear panel. As shown in FIG. 2, the flap portion 18 overlies a thin elongate side portion of said major portion 22 along side edge 32 of major portion 22 and it is to be appreciated that the adhesive strip is applied to this side portion of the rear panel.

In use of the kit of FIG. 1, the kit is preferably provided with the rear panel assembled so that the pocket is pre-formed.

Front panel 10 comprises a thin sheet of material which may readily have printed material applied thereto. For example, the front panel 10 may be of a size and of a material composition which readily permits application of printed material as by passing the same through a conventional photocopier. Similarly, the front panel 10 may be of a size and of a composition to facilitate easy printing of the material thereon by a small-sized offset printer. Such small-sized photographic machines and small-sized offset printers are readily available in, for example, small printing houses. The front panel 10 may be preferably sized, for example, to have its rectangular portion 20 of a conventional paper size such as 8½ inches by 11 inches, 8½ inches by 14 inches and the like, with its flap portion 18 to have a width of, for example, ½ inch.

With the front panel not carrying either the adhesive strip or the pocket as seen in FIGS. 1 and 2, the front panel comprises a relatively simple flat planar sheet preferably of paperboard or bristol board which can easily be handled for printing.

In use of the invention in accordance with the present invention, the kit is preferably supplied with the rear panel carrying the pocket and adhesive means and the front panel being a simple flat sheet readily adapted for photocopying or printing. Prior to assembly, the front panel may be easily printed and thereafter the kit assembled. Thus, only a small number of front panels need to be printed as is advantageous to meet customized needs of small customers.

While the preferred embodiment of FIG. 1 shows the adhesive strip 30 on the rear surface of rear panel 12, the adhesive strip could alternately be provided on the front surface of rear panel 12, to engage the outside surface of flap portion 18. While less preferred, the adhesive strip could be provided on flap portion 18 as seen in FIG. 1, and on either side thereof although providing the strip 30 on the inside would be preferable to result in a folder to appear assembled as in FIG. 2.

Figure 4:
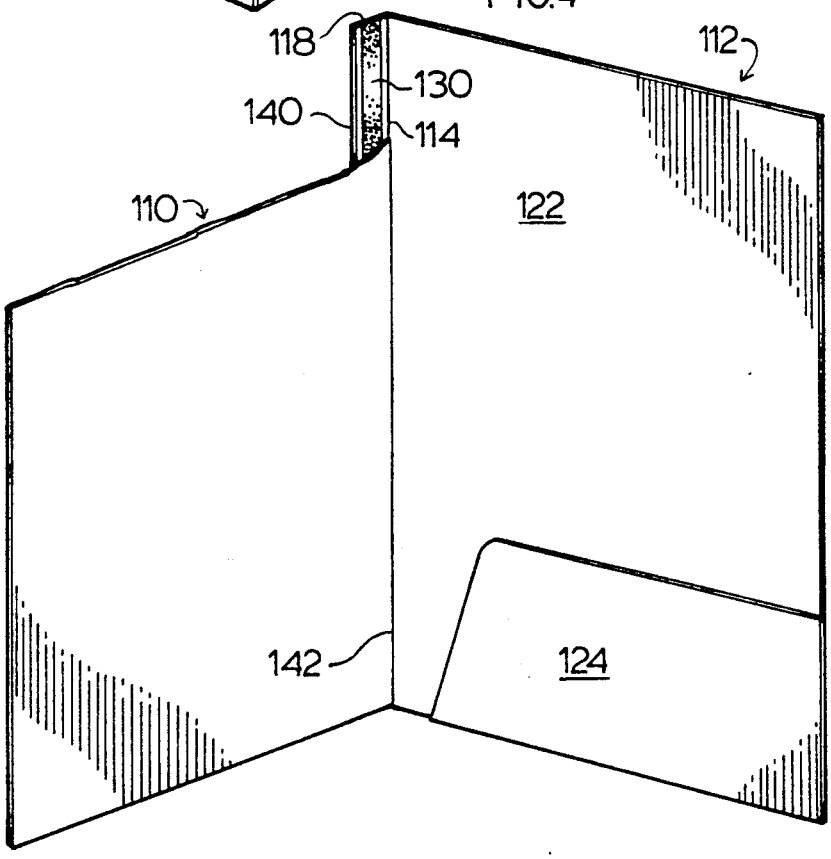
FIG. 4 shows the kit of a second embodiment assembled.

Reference is now made to FIG. 4 which shows a second embodiment of a kit in accordance with the present invention. Front panel 110 comprises a simple sheet of planar material which is adapted for photocopying or offset printing. Rear panel 112 has a scoreline 114 running along the length of one side edge 140 thereof so as to define an elongate flap 118 on one side of the scoreline and a major rectangular portion 122 on the other side. The major rectangular portion 122 carries a pocket 124. Adhesive strip 130 is applied to the front of flap portion 118 with the adhesive strip having had a removable release sheet on the upper surface thereof similar to that in FIG. 3.

In use of the kit, the front panel 110 may have printed material applied thereto by photocopying or offset printing and thereafter with the release sheet removed from the strip, the front panel may be secured to the rear panel by the front panel being placed with side edge 142 aligned with scoreline 114 so that the flap portion 118 overlies a thin elongate side portion of the front panel 112 adjacent side edge 142.

As with the first embodiment, the adhesive strip 130 may be applied to either surface of flap 118 or cover 110 adjacent its side edge 142. Preferably, however, strip 130 is on the rear panel 122.

As is to be appreciated from the drawings, with each of the embodiments, a resultant folder will have, when folded, a front panel substantially coextensive in size and dimensions with the rear panel. Thus, for example, in the first embodiment, the remaining rectangular portion is sized to be substantially identical to major portion 22. The preferred embodiment of FIGS. 1 and 2 show a file folder carrying a permanent pocket on the rear panel. This pocket is not necessary and an alternative pocket could be provided on either of the front or rear panels.

It is preferred that the one of the front or rear panel which is to have printed matter applied not carry the adhesive strip.

While the invention has been described with reference to preferred embodiments, it is not so limited. Many modifications and variations will now occur to persons skilled in the art. For a definition of the invention, reference is made to the appended claims.

The embodiments of the invention in which an exclusive property or privilege is claimed are defined as follows:

1. A kit for a portfolio folder comprising:

a separate first panel;

a separate second panel;

adhesive means for securing the first panel to the second panel, said first panel comprising a rectangular sheet having a thin elongate flap portion along one side edge thereof delineated from a remaining rectangular portion of the first panel by a hinge-forming scoreline parallel to said one side edge, said second panel comprising a rectangular sheet of dimensions substantially the same as that of said remaining rectangular portion, one of said first and second panels having pocket means on a surface thereof, said first panel adapted to be secured to the second panel with said flap portion folded along said scoreline and said flap portion overlying a thin elongate side portion of said second panel along a side edge thereof, said adhesive means secured to one of said flap portion and side portion, said adhesive means having a removable release sheet for removal to activate the adhesive means for adhesion to the other of the flap portion and side portion.

2. A kit as claimed in claim 1 wherein:

said adhesive means is a thin strip having a layer of an adhesive on each side thereof, said adhesive means secured against removal to said one of said flap portion and side portion by means of one of said layers of adhesive, said other layer of adhesive removably receiving said release sheet and enabled, when said release sheet is removed, to adhere to the other of said flap portion and side portion.

3. A kit as claimed in claim 1 wherein:

one of said first or second panels has an outer surface suitable for photocopying or offset printing.

4. A kit as claimed in claim 3 wherein:

said first panel comprises a front panel for said folder, and said second panel comprises a rear panel for said folder.

5. A kit as claimed in claim 4 wherein:

said pocket means is located on a forward facing surface of said second panel.

6. A kit as claimed in claim 5 wherein:

said adhesive means is located along said side portion.

7. A kit for a portfolio folder comprising:

a separate front panel;

a separate rear panel;

adhesive means for securing the front panel to the rear panel;

said front panel comprising a rectangular sheet having a thin elongate flap portion along one side edge thereof delineated from a remaining rectangular portion of the front panel by a hinge-forming scoreline parallel to said one side edge, said front panel having an outer surface suitable for applying printed indicia by photocopying or offset printing, said rear panel comprising a rectangular sheet of dimensions substantially the same as that of said remaining rectangular portion, said rear panel having a pocket means located on a forward facing surface of said rear panel, said front panel adapted to be secured to said rear panel with said flap portion overlying a thin elongate side portion of said rear panel along a side edge thereof, said adhesive means comprising a thin strip having a layer of adhesive on each side thereof, said adhesive means located on said side portion, said adhesive means secured to said side portion by means of one of said layers of adhesive, and having a removable release sheet for removal to activate the adhesive means for adhesion to said flap portion.

8. A kit as claimed in claim 7 wherein:

said first panel comprises a rear panel for the folder, and said second panel comprises a front panel for the folder.

9. A kit as claimed in claim 8 wherein said pocket means is located on a forward facing surface of said rear panel.

10. A kit as claimed in claim 9 wherein:

said adhesive means is located on said flap portion of said rear panel.

11. A kit for a file folder comprising:

a separate front panel, a separate rear panel, adhesive means for securing said front panel to the rear panel, said rear panel comprising a rectangular sheet having a thin elongate flap portion along one side edge thereof delineated from a remaining rectangular portion of the rear panel by a hinge-forming scoreline parallel to said one side edge, said rear panel having a pocket means located on a forward facing surface of said rear panel, said front panel comprising a rectangular sheet of dimensions substantially the same as that of said remaining rectangular portion, said front panel having an outer surface suitable for photocopying or offset printing, said rear panel adapted to be secured to said front panel with said flap portion overlying a thin elongate side portion of said front panel along a side edge thereof, said adhesive means comprising a thin strip having a layer of adhesive on each side thereof, said adhesive means located along said flap portion, said adhesive means secured to said flap portion by means of one of said layers of adhesive, said adhesive means having a removable release sheet for removal to activate the adhesive means for adhesion to said side portion.

12. A method of manufacture of a portfolio folder with printed material on a front surface thereof from a kit, said kit comprising:

a separate front panel;

a separate rear panel;

adhesive means for securing the front panel to the rear panel;

said front panel comprising a rectangular sheet having a thin elongate flap portion along one side edge thereof delineated from a remaining rectangular portion of the front panel by a hinge-forming scoreline parallel to said one side edge, said front panel having an outer surface suitable for applying indicia thereto by photocopying or offset printing, said rear panel comprising a rectangular sheet of dimensions substantially the same as that of said remaining rectangular portion, said rear panel having a pocket means located on a forward facing surface of said rear panel, said front panel adapted to be secured to said rear panel with said flap portion overlying a thin elongate side portion of said rear panel along a side edge thereof, said adhesive means comprising a thin strip having a layer of adhesive on each side thereof, said adhesive means located along said side portion, said adhesive means secured to said side portion by means of one of said layers of adhesive, and said adhesive means having a removable release sheet for removal to activate the adhesive means for adhesion to said flap portion, the method comprising:

(a) applying said printed material to said front surface of the front panel; and then (b) securing said front and rear panels together by detaching said removable release from said adhesive means and securing said flap to said side portion with said scoreline aligned with a side edge of said rear panel such that said flap portion overlies said side portion.

13. A method of manufacture of a portfolio folder with printed indicia on a front surface thereof from a kit comprising:

a separate front panel, a separate rear panel, adhesive means for securing said front panel to the rear panel, said rear panel comprising a rectangular sheet having a thin elongate flap portion along one side edge thereof delineated from a remaining rectangular portion of the rear panel by a hinge-forming scoreline parallel to said one side edge, said rear panel having a pocket means located on a forward facing surface of said rear panel, said front panel comprising a rectangular sheet of dimensions substantially the same as that of said remaining rectangular portion, said front panel having an outer surface suitable for applying indicia thereto by photocopying or offset printing, said rear panel adapted to be secured to said front panel with said flap portion overlying a thin elongate side portion of said front panel along a side edge thereof, said adhesive means comprising a thin strip having a layer of adhesive on each side thereof, said adhesive means located along said flap portion, said adhesive means secured to said flap portion by means of one of said layers of adhesive, said adhesive means having a removable release sheet for removal to activate the adhesive means for adhesion to said side portion, said method comprising:

(a) applying said indicia to said front surface of the front panel, and then (b) securing said front and rear panels together by detaching said removable release from said adhesive means and securing said flap to said side portion with said scoreline aligned with a side edge of said front panel such that said flap portion overlaps said side portion.

14. A method of manufacture of a folder as claimed in claim 12 in which said printed indicia is applied to said front surface of the front panel by passing said front panel through a photocopier or offset printer.

15. A method of manufacture of a folder as claimed in claim 13 in which said printed indicia is applied to said front surface of the front panel by passing said front panel through a photocopier or offset printer.

* * * * *